United States Patent [19]

Rhodes

[11] 3,957,603

[45] May 18, 1976

[54] ELECTROLYTIC GOLD RECOVERY AND SEPARATION PROCESS

[75] Inventor: William A. Rhodes, Phoenix, Ariz.

[73] Assignee: Electromet, Inc., Phoenix, Ariz.

[22] Filed: June 14, 1974

[21] Appl. No.: 479,284

[52] U.S. Cl. ..... 204/111

[51] Int. Cl.[2] ..... C25C 1/20

[58] Field of Search ..... 204/260, 111

[56] References Cited

UNITED STATES PATENTS

| | | | |
|---|---|---|---|
| 351,576 | 10/1886 | Cassel | 204/111 |
| 568,741 | 10/1896 | Cassel | 204/111 |
| 898,785 | 9/1908 | Ruthenburg | 204/260 |
| 3,673,061 | 6/1972 | Kruesi | 204/105 R |
| 3,736,238 | 5/1973 | Kruesi et al. | 204/105 R |

*Primary Examiner*—R. L. Andrews

*Attorney, Agent, or Firm*—Warren F. B. Lindsley

[57] ABSTRACT

A new and effective electrochemical process for the extraction of gold, silver and other precious metals from low-yield ores containing relatively large quantities of other non-precious metals wherein a novel electrolytic dissolution cell is provided for the controlled production and efficient utilization of chlorine as a solubilizing agent for the removal of the precious metals from the ore bodies.

16 Claims, 6 Drawing Figures

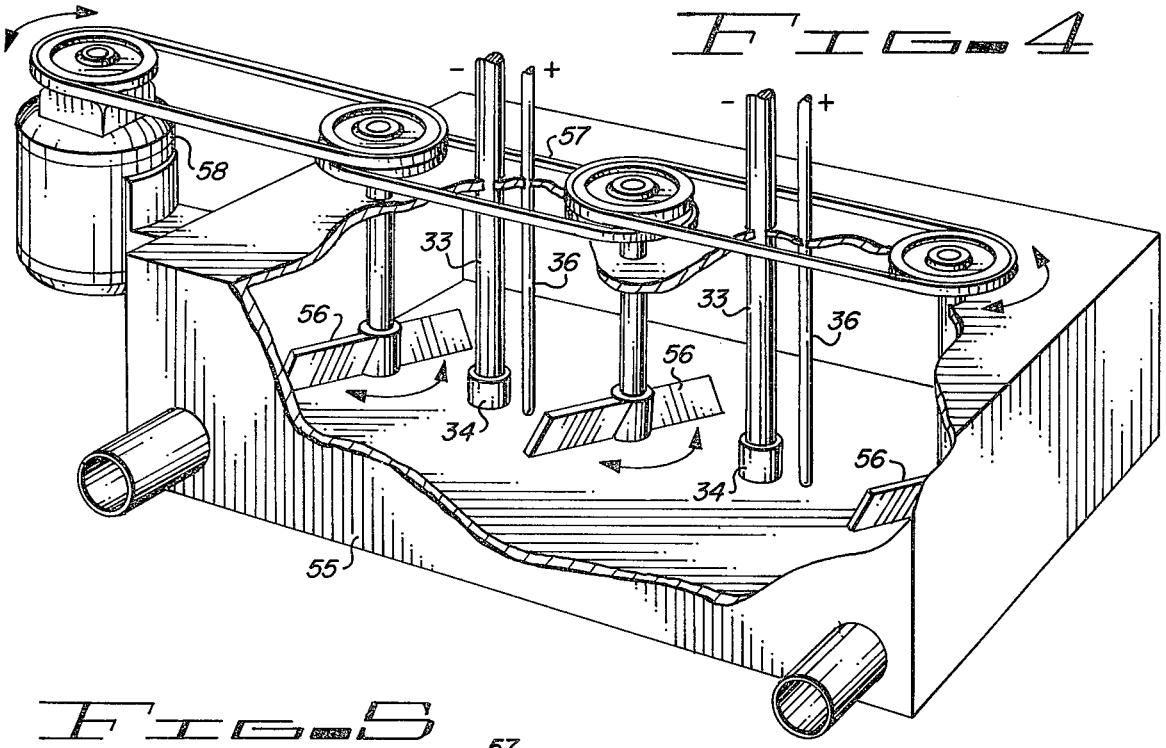
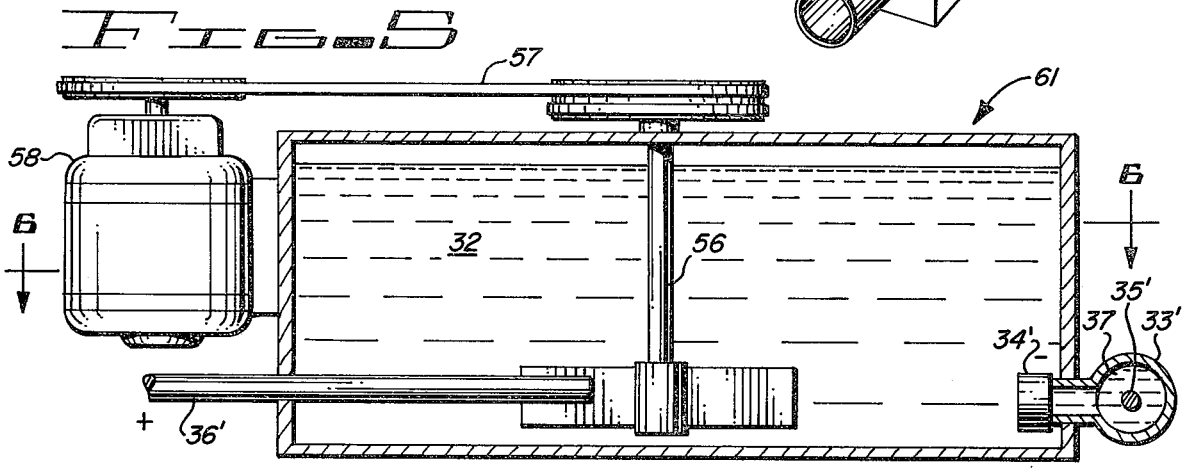
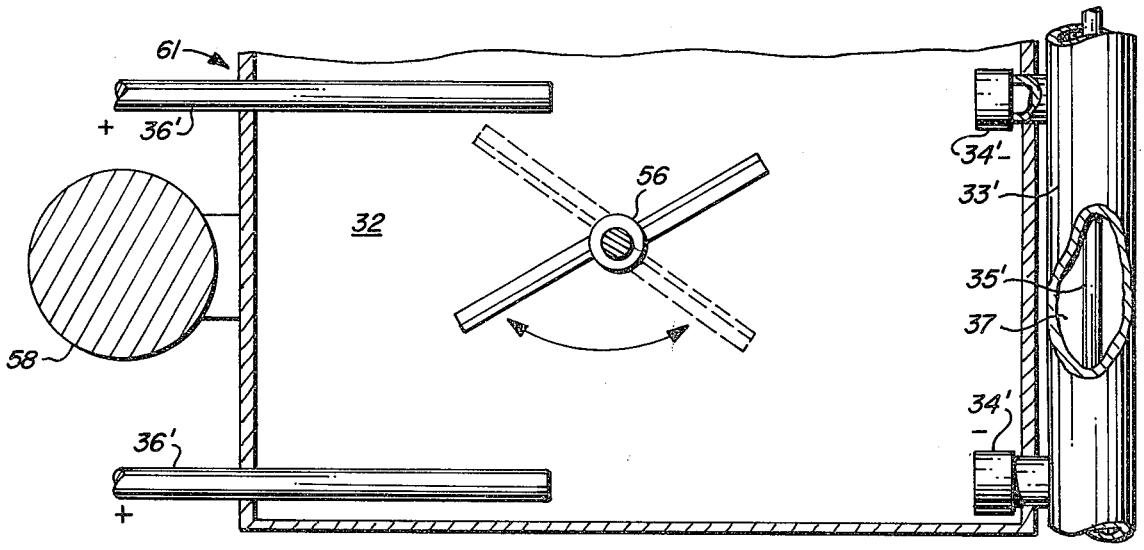
Fig-6

ELECTROLYTIC GOLD RECOVERY AND SEPARATION PROCESS

BACKGROUND OF THE INVENTION

Throughout recorded history gold has consistently been one of the most important and most sought-after minerals known to man. It has been employed for thousands of years as a form of currency, it has been fashioned into ornaments and jewelry and it has found important industrial applications as well. In very recent times the growing scarcity of gold and its importance in monetary terms have caused gold prices to skyrocket throughout the world.

The recovery of gold from its ores is commonly accomplished by one of a number of methods including flotation, amalgamation with mercury or by the cyanide process. Where the gold content of the ore is high, smelting is economical; the cyanide process is employed for the lower concentrations of gold. Where the gold content is very low relative to the amount of other metals contained, these processes all become inefficient and expensive.

Because of the difficulties and high costs associated with this grade of gold ore, many sources of gold in this category have not been fully developed and a new and appropriate method for recovering gold from these ores will undoubtedly have very significant monetary value.

SUMMARY OF THE INVENTION

In accordance with the invention claimed a new and improved electrochemical process is provided which is particularly useful for the extraction of gold from ores having a relatively low content of the precious metal and especially where the gold content is low relative to the content of other metals.

It is therefore one object of this invention to provide a economical means for the extraction of gold from its ores.

Another object of this invention is to provide an economical means for the extraction of gold from ores having a relatively low gold content.

A further object of this invention is to provide an economical means for the extraction of gold from low-yield ores where the relatively high content of other metals renders the cyanide and other processes expensive or impractical.

A still further object of this invention is to provide an economical means for the simultaneous extraction and separation of other precious metals including silver which are also commonly found in such ores.

A still further object of this invention is to provide an improved electrochemical means and process for the extraction of gold from such ores wherein the nature of the means provided readily accommodates itself to the precise control required in an economical extraction process.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which:

FIG. 4 is a partial broken away perspective view of a modification of the dissolution cell shown in FIG. 2.

FIGS. 5 and 6 illustrate end and top views of a further modification of the dissolution cell shown in FIGS. 1–4.

DESCRIPTION OF THE PREFERRED EMBODIMENT

Figure 1:
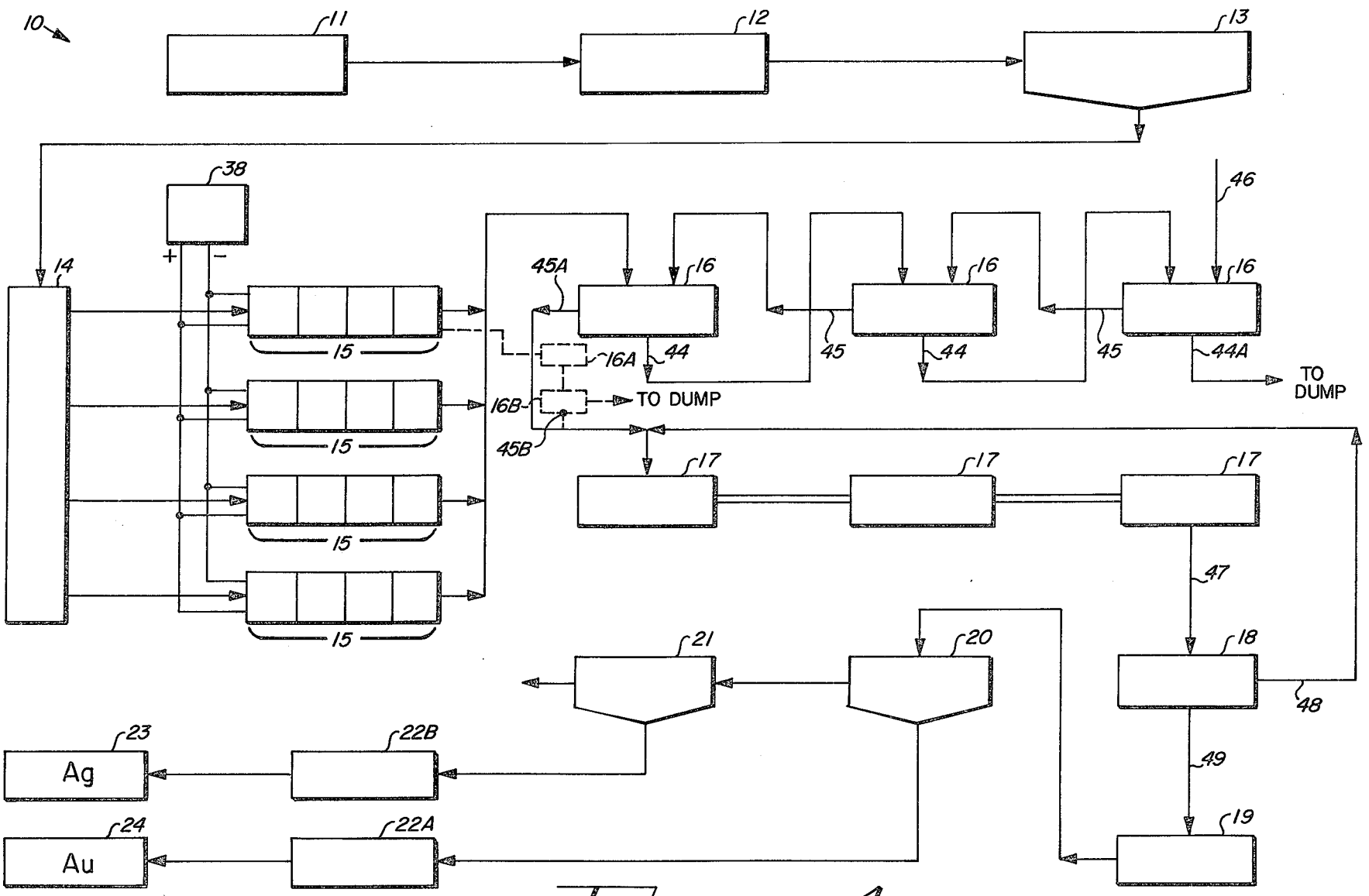
FIG. 1 is a flow sheet illustrating the successive steps comprising the electrochemical process and involving means and equipment embodying the invention.

Referring more particularly to the drawing by characters of reference, FIG. 1 disclosed the improved electrochemical recovery system 10 comprising an ore storage facility 11, a ball mill 12, a classifier 13, a special distribution box 14, a series of dissolution cells 15, rubber-linked thickeners 16, settling tanks 17, thickener 18, pressure filter 19, separation tank 20, settling and washing tank 21, melting furnaces 22A and 22B and separated silver and gold ingots 23 and 24, respectively.

Storage facility 11 may be any one of various bins or ordinary storage flats.

From storage facility 11 the ore is passed into ball mill 12 which is a standard piece of equipment commonly employed in milling operations. In ball mill 12 the ore is finely ground and should be crushed to 200 mesh size or smaller. The size of particles is designated by microns or mesh. A micron is 0.001 mm. Mesh refers to the number of screen openings per lineal inch. The opening also depends upon the wire size used in making the mesh material. The finer the ore is ground in this operation, the faster the ensuring process reaches completion. If desired a wet milling operation is possible.

The finely grounded ore passes from ball mill 12 into classifier 13 where it is slurried to the desired consistency and maintained in constant agitation at a predetermined percent solids, normally 30 percent.

From classifier 13 the slurry is transferred into distribution box 14 which is utilized to mix the slurry and the necessary chemicals and to convey the mixture of the electrochemical dissolution cells 15 where the precious metals are put into solution. Chemical additives at this point include sodium chloride and 100 to 500 parts per million bromine in the form of potassium or sodium bromide.

Figure 2:
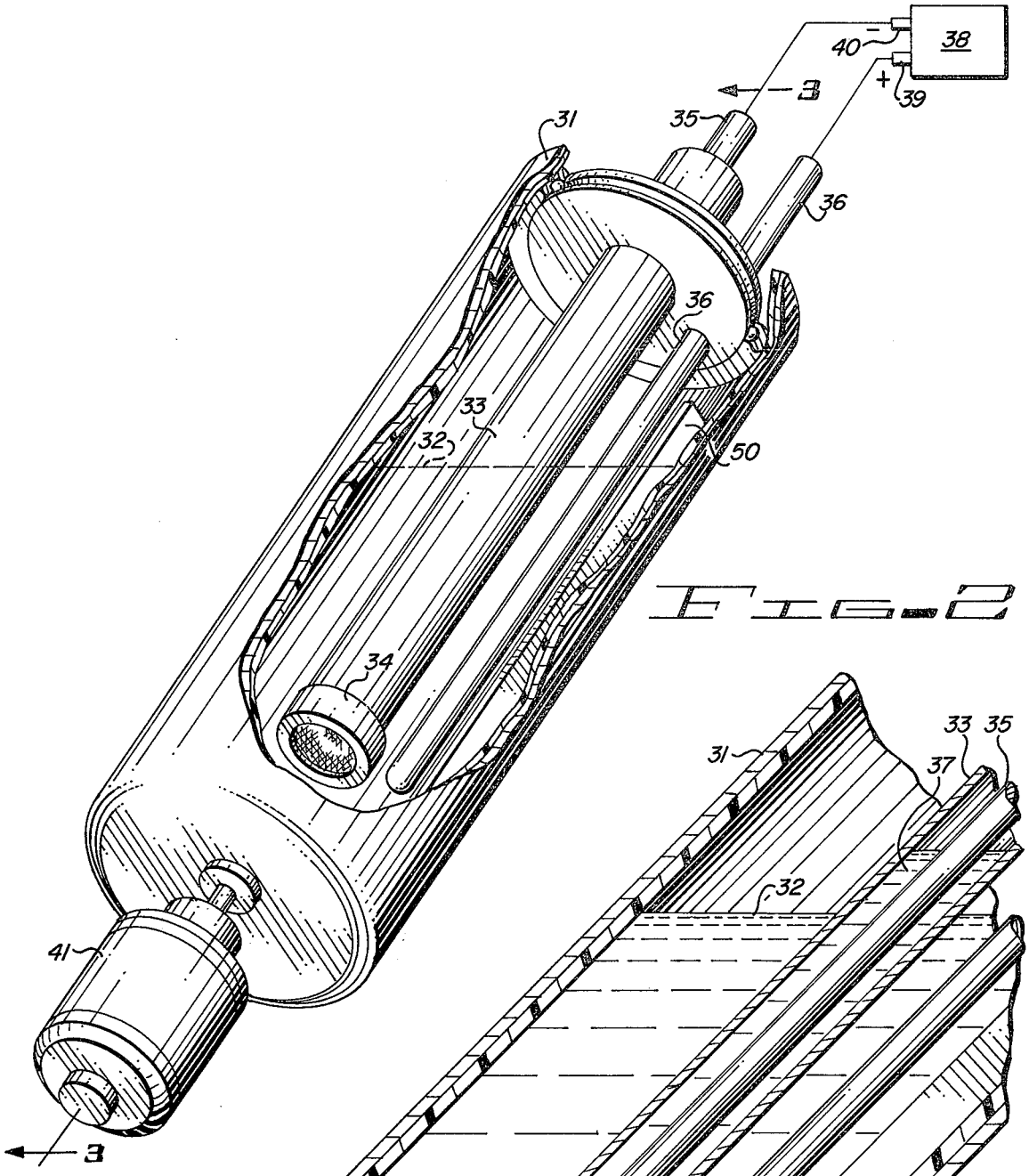
FIG. 2 is a perspective view partially broken away of a dissolution cell developed for this process and constituting one of a number of ways of implementing the process herein disclosed.
Figure 3:
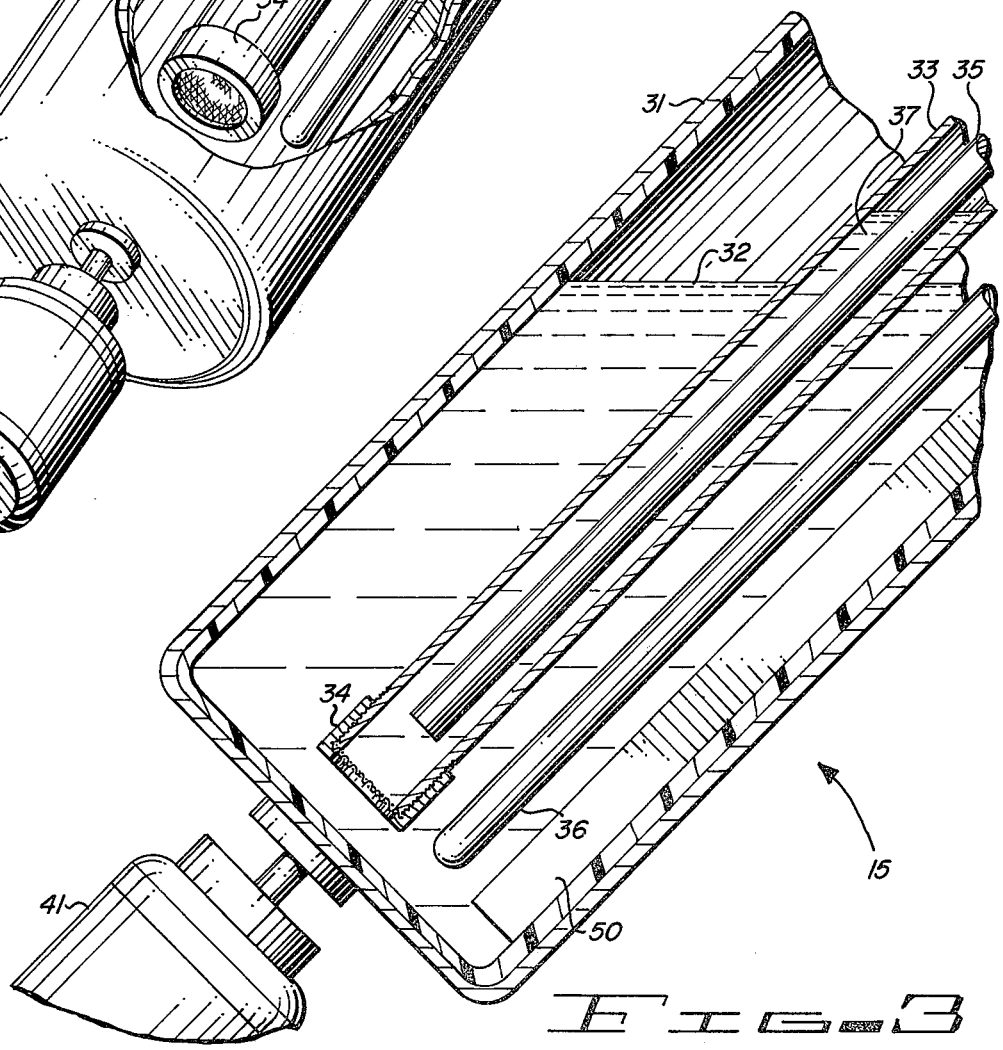
FIG. 3 is an enlarged partial cross sectional view of the structure shown in FIG. 2 illustrating more detail of the anode-cathode arrangement.

One example of the dissolution cells 15, shown in FIG. 1 comprises a cylindrical tank 31, shown in FIGS. 2 and 3 partially filled with an electrolyte 32, a cylindrical cathode chamber 33 centrally located and coaxially oriented within tank 31 and partially submerged in electrolyte 32, chamber 31 being closed at the bottom by a flat circular cap 34, a cathode electrode 35 contained within chamber 33, an anode electrode 36 located outside chamber 33 but within container 31 and partially submerged in electrolyte 32, a cathode electrolyte 37 contained within chamber 33 and surrounding a major part of the length of cathode electrode 35, a variable source of direct-current power 38 having a positive output terminal 39 connected to anode electrode 36 and having a negative output terminal 40 connected to cathode electrode 35, and a motor 41 coupled to tank 31 at its bottom surface so as to rotate tank 31 about its axis either tilted approximately 45° relative to a vertical axis or not as desired.

It should be recognized at this point that the dissolution cells 15 may comprise any suitable configuration such as a stationary tank 55, shown in FIG. 4, with one or more cathode and anode assemblies 33 and 36 arranged in the tank. A plurality of agitators 56 are shown driven through a common drive means 57 by a motor 58.

FIGS. 5 and 6 illustrate side and top views of a further modification of the dissolution cells shown in FIGS. 1–4 wherein a plurality of anodes 36' are shown as extending into a tank 61 from one side thereof and a cathode electrode 35' extending longitudinally of tank 61 along the outside of the other side thereof, as shown. It should be noted that a plurality of caps 34' extend outwardly of chamber 33' housing cathode 35' into and through the side wall of tank 61 on the opposite side of anodes 36', one opposite each of the anodes, as shown. Thus, one cathode electrode is used for a plurality of anodes.

A plurality of agitators 56 positioned along the tank 61, are driven by a common motor 58 as shown in FIG. 4.

In the construction of dissolution cells 15, chemically inert materials must be employed in the fabrication of their tanks such as tanks 31, 55 and 61, chambers 33, 33', caps 34, 34' and electrodes 35, 35' and 36, 36'. In some cases inert liners or surface coatings may be employed as, for example, rubbr or glass liners inside the tanks. Cathode electrode 35, 35' are preferably of nickel or stainless steel. Anode electrodes 36, 36' are a graphite or carbon rod. Cathode chamber 33, 33' must be made from a material which is both chemically inert and electrically insulating. Pyrex has been found to be suitable for this purpose. Caps 34, 34' are of a porous material of very fine pore size so that while it is capable of absorbing the electrolyte solution and therefore capable of passing an electric current it prevents the free mixing of chemicals from inside cathode chambers 33, 33' with those outside these chambers. Glass frit has been used with great success for the fabrication of caps 34, 34' while polyethylene screens covered with 50–100 grit sand have also proven satisfactory. When the glass frit is employed it is fused to the end of pyrex chamber 33, 33'.

The electrolyte 37 contained within chambers 33, 33' is an initially saturated solution of sodium chloride having a ratio of 35 grams of sodium chloride to 100 cubic centimeters of water. Electrolyte 32 contained within chambers 31, 31' is water containing between 3 and 6 percent sodium chloride depending on the ore richness.

In the operation of dissolution cells 15 the ore slurry from distribution box 14 is injected into electrolyte 32, and while motor 41 rotates tank 31 or motors 58 and 61 agitate the solution in tanks 55 and 61 at two to six revolutions per minute, for example, a controlled electrical current is passed from positive terminal 39 of direct-current source 38 to anode electrode 36, into electrolyte 32 through porous caps 34, 34' and electrolyte 37 to cathode electrodes 35, 35' and to negative terminal 40 of source 38 depending on what type of cell is used.

Sodium Chloride (NaCL) in water dissociates into sodium ion ($Na^+$) and chlorine ion ($Cl^-$). By the action of the electric field, negatively charged chlorine ion is drawn towards the anode electrodes 36, 36' whereas sodium ion is drawn towards the cathode. The chlorine is immediately utilized to solubilize gold, silver and other metals which might be present in the ore in the vicinity of the electrodes 36, 36' forming these metals in colloidal form and remaining in the solution. The sodium ion on the other hand generated within the chamber 33, 33' captures hydroxyl molecule (OH) from water forming sodium hydroxide. This sodium hydroxide is a valuable by-product and is used in a later stage of the recover process shown in dash lines in FIG. 1.

In earlier experiments utilizing chlorine as a solubilizing agent for precious metals the gas has ben injected into the slurry from a tank. The solubilizing process in this case was very slow and a large portion of the gas was lost to the atmosphere while only a small part of it was applied to its intended purpose. This very inefficient use of the chlorine resulted from its poor distribution within the ore slurry and from the lack of an effective control over its injection rate.

The dissolution cell 15 overcomes this problem by virtue of its novel means for chlorine injection by generating chlorine ions ($Cl^+$) in its most active state. By electrolysis, the active or nascent chlorine is drawn along the entire submerged length of the anode electrode. In addition, as tank 31 is rotated slowly by motor 41 or the agitators of tanks 55 and 61 are slowly rotated, a constantly fresh supply of slurry is moved past stationary electrodes 36, 36' so that a high degree of exposure to the generated chlorine is provided for the total amount of slurry under treatment. Furthermore, the excessive generation of chlorine as evidenced by bubbling off at the surface may be readily prevented by control of direct current source 38. This control may be accomplished manually or automatically using sensors and feedback control of source 38. In yet another enhancement of the dissolution cells' performance it was found that the addition of 100 to 500 parts per million of bromine in the form of potassium or sodium bromide, the concentration of chlorine as coupled with bromine increased many times over the original.

For most efficient and economical operation the sodium chloride concentration should be between three and six percent. Below three percent an excessive amount of oxygen is generated wasting electrical energy; above six percent no oxygen is evident and the curve of chlorine generated vs. electrical energy remains substantially flat up to a concentration of ten percent. Beyond that point sodium chloride tends to be wasted in the slurry. Ordinary sea water aftr adjusting the strength appropriately can also be used.

As the dissolution process continues and as more and more of the precious metals pass into solution it will be noted that lower and lower levels of electrical current must be held to prevent excessive surface gassing of chlorine. The end point of the process is thus evidenced by a very low level of permissible current. When this point is reached the pregnant liquor, i.e., the electrolyte with its dissolved precious metals is immediately separated from the balance of the ore slurry. If the separation is postponed more than a few hours a slight drop in precious metal yield can be expected as the reagents give up the metals again to the ore body.

Separation of the dissolved metals begins as the pregnant liquor and slurry is transferred from the tanks of the cells 15 into the rubber-lined thickeners 16. The thickeners 16 are standard equipment commonly employed in milling operations for the separation of liquids from solids. As diagrammatically illustrated in FIG. 1, a series of thickener tanks 16 are provided. At the bottom of each tank there is a solids exhaust port 44 while near the surface of each tank there is a liquids exhaust port 45. The solids from a given tank 16 which have settled toward the bottom are removed through port 44 and are pumped into the next tank to the right while the liquids on the surface of a given tank 16 are removed through port 45 and are pumped into the next tank to the left. The solids are thus moved progressively in one direction while the liquids are moved in the opposite direction. Additional water or other washing solution 46 is injected into the thickener tank to insure thorough removal of the dissolved metals from the ore body prior to final removal of the depleted ore at part 44A.

The pregnant liquor removed at port 45A will appear yellow in correspondence with the amount of gold present. If the liquor is clear a very low gold content is indicated.

From exhaust port 45A the pregnant liquor is transferred to the series of precipitating settling tanks 17. In tanks 17 the dissolved gold and silver chlorides are forced into a fine metallic precipitate by the addition of sodium dithionite or hydrosulfite ($Na_2S_2O_4$) which is a powerful dechlorinator. As the sodium dithionite powder is added in small amounts the pH of the solution moves toward the acid side and continues to do so as long as halogens are being cleaned from the metals or from the metal-free liquor. As soon as most of the halogens have been removed the gold and silver metals appear as a black or blue-black cloud and the pH change tapers off sharply and comes to rest, no further pH change occuring as additional amounts of dithionite are added. A further evidence of the completion of this process is the odor of the dithionite. If still more dithionite is added a white cloud of sulfur may suddenly be produced. This occurrence does not result in a loss of metal but adds the requirement for a special clean up operation. Experimental studies have indicated that for most effective colloidal triggering in this part of the process the liquor should be held at a pH between 5 and 9 and preferably between 7 and 8. Adjustment of the pH is accomplished by addition of the hydroxide solution generated within cathode chamber 33, 33' of dissolution cells 15 or normal sodium hydroxide solution.

Once the cloud of colloidal gold and silver appears in tanks 17 automatic flocculation occurs and, upon very slow stirring or quiet settling the particles settle to the bottom leaving the clear liquor at the top. At this point it is expedient to move the pH liquor toward a value of 4 or 5, preferably with small amounts of hydrochloric acid. This procedure eliminates the attachment of hydroxyl groups to metal particles which are impossible to filter.

The output of the settling tanks 17 is removed at port 47 and discharged into a single-stage thickener tank 18. A portion of the liquids from thickener tank 18 is returned via line 48 for recycling through settling tanks 17 to insure a thorough treatment of the complete removal of precious metals from the solution.

The solids from tank 18, i.e. the colloidal precious metals and residual liquids are removed from tank 18 via exhaust port 49 and are passed into pressure filter 19. The filter employed here must be impervious to mineral acids and must have a pore size from 2 to 50 microns.

The output of filter 19 is transferred to separation tank 20 in the form of a black cake. In separation tank 20 the silver and gold metals are separated one from the other in the following manner:

The cake is first washed with distilled water to the point where a silver nitrate test shows the wash water to be free of sodium chloride.

Concentrated nitric acid is then applied in sufficient quantity to produce saturation. An immediate reaction occurs in which silver and other trace metals are dissolved. The silver and other metals are then washed away and the remaining black colloidal gold is ready for melting in furnace 22A from which it is poured and cooled into gold ingots 24. In the melting process it is necessary to increase the heat very slowly to a dull red or black red, so that the yellow stage is reached without loss of colloidal particles to the atmosphere. The gradual heating also vaporizes all traces of sulfur and the sides of the crucible must be heated simultaneously to prevent recondensation of the sulfur thereon and subsequent contamination of the melt.

Meanwhile the dissolved silver is transferred into settling tank 21 where the silver is again returned to a state of colloidal suspension for separation, washing and transfer to melting furnace 22B, finally to be discharged and poured into silver ingots 23.

The dimensions and the number of dissolution cells 15 employed in a typical milling operation are, of course, dependent upon the size of the operation, the grade of the ore and other economic considerations. The dimensions and the number of the electrodes 35 and 36 must be adequate to handle the required level of electrical energy such that a maximum level of 1 to 3 watts per 6 square inches of electrode area is not exceeded. Higher levels can be tolerated for assay purposes but not in large scale milling operations because of the resulting heating and bombardment of colloidal particles off the electrodes as evidenced by the appearance of an oily film on the surface of the leach liquor.

For very large versions of the dissolution cells 15 it will be found advantageous to add one or more agitator vanes 50 around the sides of tank 31 to insure thorough mixing of the slurry and electrolyte.

A complete electrochemical process for the effective, efficient and economical removal and separation of gold, silver and other precious metals from relatively low-yielding ores has thus been provided, the process utilizing a novel dissolution cell which enables the efficient generation and utilization of chlorine as a solubilizing agent.

In addition to the novelty of the dissolution cells, the importance of using the disclosed pH factors for flocculating, separating and automatically controlling the separation and extraction of metals out of solution should be noted.

To remove all the unwanted metals such as iron, copper, etc. that may have gone into solution along with gold and silver, the circuit of FIG. 1 may be modified as shown in dash lines so that sodium hydroxide from cathode container 31 is added to the pregnant liquor while the pregnant liquor is mixed uniformly until it has reached a pH rating of 8–9. At this point all hydroxides of metals other than gold and silver will form clusters of flakes and fall to the bottom of tank 16A shown in FIG. 1. The pregnant liquor along with the unwanted hydroxides of metals and other impurities is pumped into pressure filter 16B where the hydroxides of unwanted metals and other impurities are filtered out leaving the pregnant solution containing only gold and silver in solution.

From exhaust port 45B of pressure filter 16B the pregnant liquor containing only gold and silver at this point is transferred to the series of precipitating and settling tanks 17. In precipitating and settling tanks 17 the gold and silver are forced into a metallic colloidal state. This is accomplished alternately as follows:

1. Bring pregnant liquor to pH rating of 6–7 using hydrochloric or nitric acid.
2. Let pregnant liquor set at this stage a few minutes.
3. Add a small amount of sodium hydrosulfite.
4. Bring pregnant liquor back to pH rating of 6–7 using hydrochloric or nitric acid.
5. At this point gold and silver will come out of solution in the form of blue-black flakes (gold and silver sulfites) which at first form a black cloud then they begin to grow in size and gradually settle to the bottom of the tank due to gravity.

While steps 1 through 5 above are being accomplished the pregnant liquor is stirred to speed up the mixing and enhance the uniformity of the mixture. When the gold and silver begin to flocculate (step 5) the stirring rate is reduced gradually and then stopped completely to allow the gold and silver sulfite flakes to grow in size and settle to the bottom of the tank.

Although but a single embodiment of the present invention has been illustrated and described, it will be apparent to those skilled in the art that various changes and modifications may be made therein without departing from the spirit of the invention or from the scope of the appended claims.

What is claimed is:

1. An electrochemical process for the extraction of gold from low-yield ores comprising:

mixing milled gold bearing ore with water and sodium chloride in a first container to form a slurry, placing a positively charged anode in said first container to extend below the surface of said slurry, said slurry forming a first electrolyte, placing a negatively charged cathode in a second container containing a second electrolyte, said second container formed at least in part by a porous fluid isolating material, connecting said second container to said first container below the surface of the slurry in said first container so that upon the passage of electric current between said anode and cathode through said porous fluid isolating material chlorine generated at the anode and sodium hydroxide generated at the cathode are kept separated in said first and second containers, thereby allowing nascent chlorine generated at said anode to disperse in said slurry to solubilize gold particles in said slurry into gold chloride thereafter to be separated from said slurry as a pregnant liquor, and dechlorinating said pregnant liquor to release gold in the form of colloidal particles.

2. The electrochemical process set forth in claim 1 wherein:

sodium dithionite is used to dechlorinate said pregnant liquor.

3. The electrochemical process set forth in claim 2 in further combination with the process step of:

flocculating said colloidal particles by reducing the pH rating of said pregnant liquor.

4. The electrochemical process set forth in claim 3 wherein:

said flocculation occurs by introducing into said pregnant liquor sodium hydroxide and by controlling the pH rating of said pregnant liquor.

5. The electrochemical process set forth in claim 4 in further combination with the process step of:

rendering said pregnant liquor again more acid to destroy the OH bands of the flocculated colloidal particles.

6. The electrochemical process set forth in claim 4 in further combination with the process steps of:

separating said pregnent liquor from the flocculated colloidal particles, and washing said colloidal particles with nitric acid to solubilize and remove other mineral elements therefrom.

7. The electrochemical process set forth in claim 3 wherein:

said flocculation occurs by introducing into said pregnant liquor sodium hydroxide generated at said cathode.

8. The electrochemical process set forth in claim 1 in further combination with the process step of:

agitating said slurry during the isolation process.

9. The electrochemical process set forth in claim 8 wherein:

said second electrolyte comprises a solution of sodium chloride more concentrated than the slurry forming said first electrolyte.

10. The electrochemical process set forth in claim 1 wherein:

said second container is placed in said first container and arranged to extend below the slurry in said first container.

11. An electrochemical process for the extraction of gold and silver from low yield ores comprising:

mixing milled gold and silver bearing ore with water, potassium sodium bromide and sodium chloride in a first container to form a slurry, placing a positively charged anode in said first container to extend below the surface of said slurry, said slurry forming a first electrolyte, placing a negatively charged cathode in a second container containing a second electrolyte comprising a solution of sodium chloride, said second container formed at least in part by a porous fluid isolation material.

connecting said second container to said first container below the surface of the slurry in said first container so that upon the passage of electric current between said anode and cathode through said porous fluid isolation material chlorine generated at the anode and sodium hydroxide generated at the cathode are kept separated in said first and second containers, thereby allowing nascent chlorine generated at said anode to disperse in said slurry to solubilize gold particles in said slurry into gold chloride thereafter to be separated from said slurry as a pregnant liquor, dechlorinating said pregnant liquor with sodium dithinonite to release gold from said slurry in the form of colloidal particles, flocculating said colloidal particles by reducing the pH rating of said pregnant liquor by the introduction of sodium hydroxide thereinto, rendering said pregnant liquid more acid to destroy the OH bands of the flocculated colloidal particles, washing said colloidal particles with nitric acid to solubilize and remove other mineral elements therefrom, placing the residue of the separated pregnant liquor in a settling tank, and returning silver to its state of colloidal suspension for separation.

12. The electrochemical process set forth in claim 11 wherein:

said second container is placed in said first container to extend below the surface of the slurry in said first container.

13. An electrochemical process for the extraction of gold from low-yield ores containing other unwanted metals comprising:

mixing milled gold bearing ore with water and sodium chloride in a first container to form a slurry, placing a positively charged anode in said first container to extend below the surface of said slurry, said slurry forming a first electrolyte, placing a negatively charged cathode in a second container containing a second electrolyte, said second container formed at least in part by a porous fluid isolating material, placing said second container in said first container below the surface of the slurry in said first container so that upon the passage of electric current between said anode and cathode through said porous fluid isolating material chlorine generated at the anode and sodium hydroxide generated at the cathode are kept separated in said first and second containers, thereby allowing chlorine generated at said anode to disperse in said slurry to solubilize gold particles in said slurry into gold chloride thereafter to be separated from said slurry as a pregnant liquor, mixing sodium hydroxide into said pregnant liquor until said pregnant liquor has reached a pH rating between 8 and 9, whereby all hydroxides of metals other than gold and silver will form clusters of flakes and fall to the bottom of said pregnant liquor, filtering out the hydroxides of metal other than gold and silver from said pregnant liquor, and dechlorinating said pregnant liquor to release gold in the form of colloidal particles.

14. The electrochemical process set forth in claim 13 in further combination with the steps of:

bring said pregnant liquor to a pH rating of between 6 to 7 using hydrochloric acid, after a few minutes adding a small amount of sodium hydrosulfite to said pregnant liquor, and adding any necessary hydrochloric acid to return said pregnant liquor to a pH rating between 6 and 7 at which time gold and silver will flocculate as silver and gold sulfites.

15. The electrochemical process set forth in claim 14 wherein:

nitric acid is used in place of hydrochloric acid.

16. The electrochemical process set forth in claim 14 wherein:

said pregnant liquor is stirred at a reducing rate of speed during the flocculation of said gold and silver sulfite flakes until they settle in said liquor.

* * * * *

UNITED STATES PATENT OFFICE

CERTIFICATE OF CORRECTION

Patent No. 3,957,603 Dated May 18, 1976

Inventor(s) William A. Rhodes

It is certified that error appears in the above-identified patent and that said Letters Patent are hereby corrected as shown below:

Claim 6, line 3, after "said" cancel "pregnent" and substitute ---pregnant---;

Claim 11, line 13, after "material" cancel the period and substitute ---,---;

Claim 14, line 4, after "6" cancel "to" and substitute ---and---.

Signed and Sealed this

Seventh Day of September 1976

[SEAL]

*Attest:*

RUTH C. MASON
*Attesting Officer*

C. MARSHALL DANN
*Commissioner of Patents and Trademarks*